US008502102B2

(12) United States Patent
Eriksson et al.

(10) Patent No.: US 8,502,102 B2
(45) Date of Patent: Aug. 6, 2013

(54) DC SWITCHING DEVICE

(71) Applicants: Thomas Eriksson, Balinge (SE); Lars Banghammar, Vasteras (SE)

(72) Inventors: Thomas Eriksson, Balinge (SE); Lars Banghammar, Vasteras (SE)

(73) Assignee: ABB Research Ltd. (CH)

( * ) Notice: Subject to any disclaimer, the term of this patent is extended or adjusted under 35 U.S.C. 154(b) by 0 days.

(21) Appl. No.: 13/683,848

(22) Filed: Nov. 21, 2012

(65) Prior Publication Data

US 2013/0075367 A1 Mar. 28, 2013

Related U.S. Application Data

(63) Continuation of application No. PCT/EP2010/057386, filed on May 28, 2010.

(51) Int. Cl.
*H01H 33/00* (2006.01)

(52) U.S. Cl.
USPC ..... 218/150; 218/149; 218/34

(58) Field of Classification Search
USPC . 218/34–41, 15, 147–151, 156–158; 335/201
See application file for complete search history.

(56) References Cited

U.S. PATENT DOCUMENTS

| | | | | |
|---|---|---|---|---|
| 5,004,874 | A * | 4/1991 | Theisen et al. | 218/151 |
| 5,138,122 | A * | 8/1992 | Moldovan et al. | 218/22 |
| 7,915,985 | B2 * | 3/2011 | Schmitz et al. | 335/201 |
| 2010/0126966 | A1 * | 5/2010 | Domejean et al. | 218/149 |

FOREIGN PATENT DOCUMENTS

| | | |
|---|---|---|
| EP | 2061053 A2 | 5/2009 |
| EP | 2189996 A1 | 5/2010 |

OTHER PUBLICATIONS

International Search Report and Written Opinion of the International Searching Authority Application No. PCT/EP2010/057386 Completed: Feb. 11, 2011; Mailing Date: Feb. 23, 2011 8 pages.

* cited by examiner

*Primary Examiner* — Tulsidas C Patel
*Assistant Examiner* — Marina Fishman
(74) *Attorney, Agent, or Firm* — St. Onge Steward Johnston & Reens LLC

(57) ABSTRACT

A DC switching device including a plurality of arc-extinguishing chambers and a plurality of contacting units conductively connected in series to each other, each of the contacting units including a stationary contact and a movable contact movable between a rest position and a working position, an air gap is formed between the contacts when the movable contact is moved from the working position to the rest position and each of the chambers enclosing a contacting unit and including a splitter plate unit including one or more splitter plates arranged for splitting and cooling an arc occurring in the air gap between the contacts. The chambers include a permanent magnet for generating a magnetic field between the contacting unit and the splitter plate unit and the splitter plates are made of non-ferromagnetic material, and the splitter plates of the chambers are made of ferromagnetic material.

6 Claims, 6 Drawing Sheets

DC SWITCHING DEVICE

FIELD OF THE INVENTION

The present invention relates to a DC switching device for switching direct current electric power and more particularly, it relates to a DC switching device that includes a contacting unit comprising a stationary and a movable contact movable between a rest position and a working position and, a mechanism for extinguishing arcs formed between the contacts during separation of contacts.

BACKGROUND OF THE INVENTION

DC power for example battery or solar power is often used in low-voltage applications and/or as power supply for electric circuits. A DC switching device is provided between the DC power and a load of an electric circuit system to connect and disconnect the DC power to the load.

In a working position, the movable contact is in contact with the stationary contact, while when a current is disconnected, an air gap is established and an arc is inevitably generated between the contacts. This arc can be very destructive and must therefore be contained, cooled and extinguished in a controlled way so that the air gap between the contacts can withstand the voltage in the circuit. One way to withstand the voltage is to provide the DC switching device with an arc-extinguishing chamber including one or more splitter plates for dividing the arc into partial arcs and thereafter cooling it off.

Voltage is a more important factor for a DC switching device when breaking a current. For an AC switching device, current zero is used to facilitate arc extinguishing since at current zero it is optimal for preventing an arc from continuing. Nevertheless, this is not a case for the DC application which the current has a steady state value.

Left uncontrolled, voltage may give a new life to the arc. If it reignites, it can damage the whole electrical system. Therefore, the DC switching device has to take this process into account by opening the contacts and extinguishing the arc simultaneously.

A high breaking capability is one of desired features when designing/selecting a DC switching device. However, the short distance of the air gap between the contacts results in a limited voltage drop across the air gap, the breaking capability of the DC switching device in term of voltage, current and time is therefore limited when the DC switching device is used in a relatively higher voltage and current application.

Many switching device manufactures produce AC switching devices including three poles corresponding to three AC phases and a contacting unit is provided for each of poles. When this type of AC switching devices is adapted for a DC application, a simple wiring is obtained by connecting the contacting units to each other in series. This feature is often desired by many customers.

A U.S. Pat. No. 5,004,874 presents a DC switching apparatus having two arc extinguishing chambers each comprising a pair of spaced conductors providing cooperable arc runners divergent toward a row of non-ferromagnetic splitter plates and a stationary contact conductively mounted on one conductor, the stationary contacts of respective chambers being mounted on respectively opposite conductors and corresponding conductors in respective chambers are conductively connected to each other and to power terminals of the apparatus, permanent magnets applying a magnetic field across the respective chamber for moving an arc within the chamber, ferromagnetic plates providing flux return paths to optimize and maximize the magnetic field, a movable contact extending into each chamber bridging the stationary contacts and movable to separate from the stationary contacts, drawing an arc therebetween in each chamber, the arc in one chamber bridging the pair of conductors within that chamber establishing a circuit comprising the arc between the conductors and the power terminals in shunt of the movable contact, thereby eliminating the arc in the other chamber, the bridging arc being extinguished in the splitter plates, interrupting the circuit. The magnetic fields are applied in opposite directions in the respective chambers for non-polarized operability of the apparatus and are distorted within the splitter plate area to drive and maintain an arc at a stable arc position against a thickened sidewall portion to withstand erosion. The arrangement of two arc-extinguishing chambers enables the DC switching device to be used as a non-polarized switching device.

SUMMARY OF THE INVENTION

One object of the present invention is to provide a DC switching device capable of switching relatively high voltage and current DC power.

It is a further object of the invention to provide an economical and efficient manufacturing, wherein, a three-pole AC switching device is adapted for a DC application.

This object is achieved by a DC switching device. The DC switching device is characterized in that at least one of the chambers includes a permanent magnet for generating a magnetic field between the contacting unit and the splitter plate unit and the splitter plate is made of non-ferromagnetic material, and the splitter plates of at least one of the chambers are made of ferromagnetic material.

As a current being disconnected, the movable contact may be separated from the stationary contact, an air gap is established and an arc is generated between the stationary and movable contacts. By providing the arc-extinguishing chamber with the permanent magnet, a magnet field is generated in the entire extinguishing area of the chamber. This magnetic field builds up a magnetic driving force that drives through the arc away from the contacts and into the splitter plates. Therefore, the arc can be quickly split and cooled off. The maximum effect of the splitter plates is therefore obtained, which increases a sufficient voltage drop and results in a quicker arc extinguishing. Consequently, an overall breaking capability is increased.

The splitter plates enclosing in the chamber may be made of non-ferromagnetic material and the chamber is provided with the permanent magnet. One advantage is that this construction prevents occurrences of short-circuits that may be generated by splitter plates made of metallic ferromagnetic material and decrease the magnetic driving force drastically. To maintain a uniform magnetic field distribution, one single piece of permanent magnet is preferred so that the arc is always driven in a favorable direction.

According to another embodiment of the invention, the permanent magnet is arranged adjacent to the splitter plate unit of the chamber to provide maximum effect.

In accordance with an embodiment of the invention, the permanent magnet is extending from the stationary contact and further along one side of the splitter plate unit.

According to an embodiment of the invention, the permanent magnet is preferably arranged to cover between 70%-90% of the side of the splitter plate unit.

According to a preferred embodiment of the invention, a second permanent magnet is arranged on the opposite side of the splitter plate unit. The arrangement of the first and second permanent magnets provide a symmetrical and balanced magnetic force and local effects of trapping the arc close to the wall of the chamber are avoided.

According to an embodiment of the invention, the DC switching device comprises three chambers arranged next to each other in a row, the contacting unit of the mid chamber having a current direction opposite to the current directions of other contacting units of the other two chambers, the splitter plates of the mid chamber are made of ferromagnetic material and each of the other two chambers includes a permanent magnet and the splitter plates are made of non-ferromagnetic material.

In case that an AC switching device having at least three poles for a three-phase AC application is adapted as a DC switching device in a DC application, the poles of the switching device may be connected in series to each other for simplifying the wiring of the switching. This means that the contacting unit of the mid chamber has a current direction opposite to the other contacting units. By providing the mid chamber with the splitter plates made of ferromagnetic material and each of other two with the splitter plates made of non-ferromagnetic material and a permanent magnet, a maximum flux density from the permanent magnet is obtained because all the magnetic fields will have the same directions while an opposite magnetic direction will result in a lower magnetic flux density and consequently, a lower breaking capacity.

Such a DC switching device may be arranged to operate DC applications with voltage up to 1500 V and current up to 250 Amp.

BRIEF DESCRIPTION OF THE DRAWINGS

The invention will now be explained more closely by the description of different embodiments of the invention and with reference to the appended figures.

DETAILED DESCRIPTION OF THE INVENTION

Figure 1A:
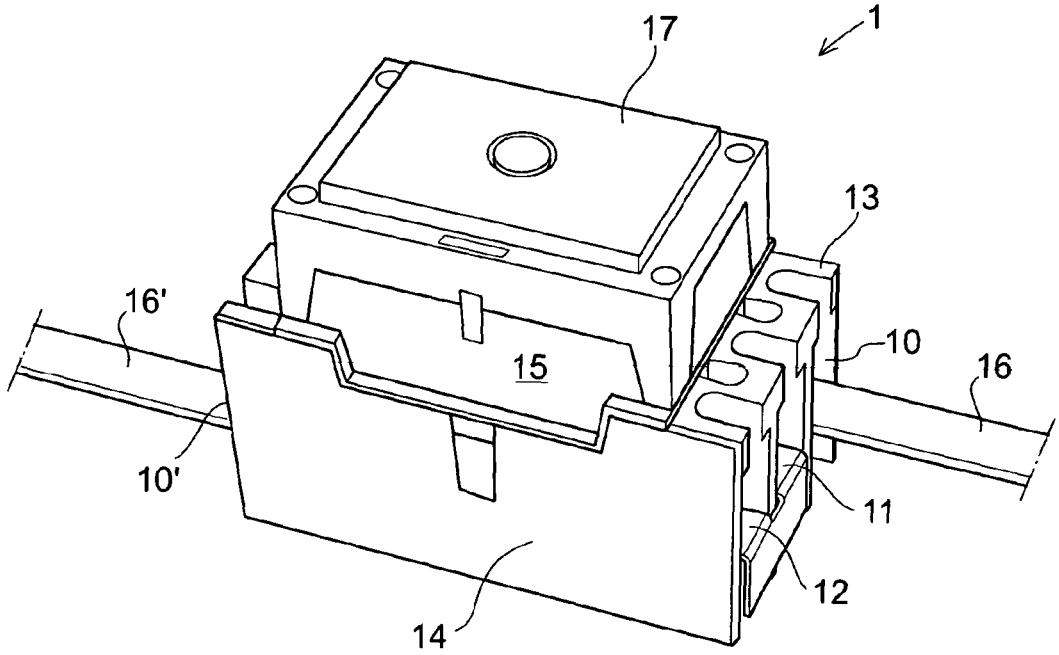
FIGS. 1A-1B show respectively an isometric and an overhead view of a sealed electromagnetic contactor with two power terminals extending from each of sides opposite to each other, the contactor including three poles.
Figure 1B:
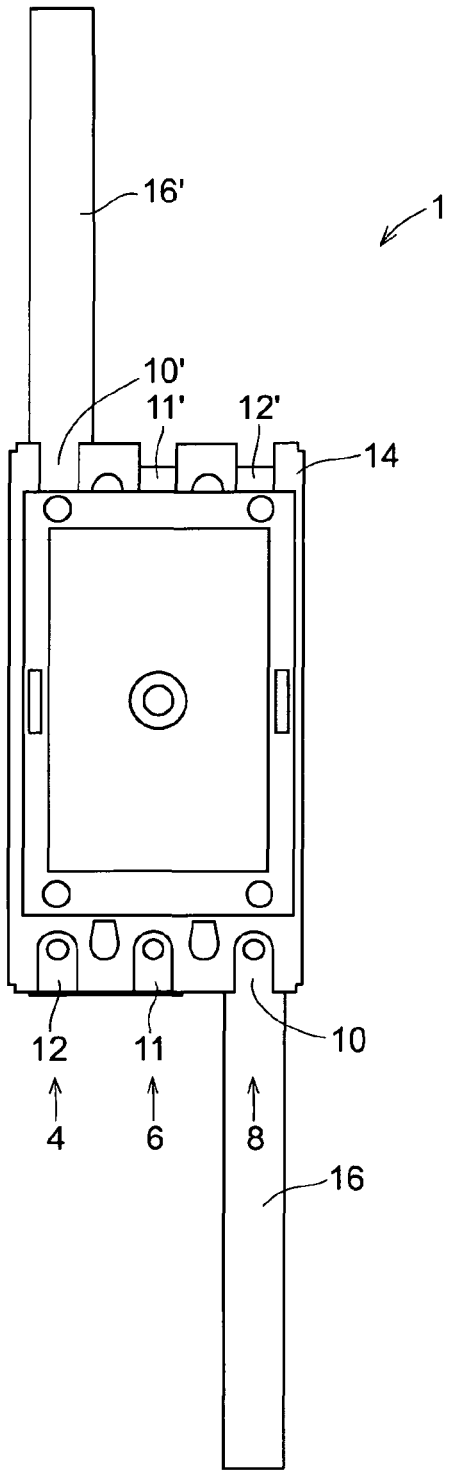

FIGS. 1*a* and 1*b* show respectively an isometric and an overhead view of a sealed electromagnetic contactor 1 comprising a housing portion 13 and a casing portion 17. The housing 13 is positioned at the bottom of the contactor in view of the FIG. 1*a* and includes further a frame 15 and a seat 14, while the casing portion 17 is positioned on the top part of the contactor. In this example, the contactor further includes six connectors 10, 11, 12, 10', 11' and 12', wherein two connectors 10 and 10' are arranged for connecting the contactor in an electric circuit via power terminals 16 and 16' and, the connector 10 is connected to the terminals 16 adapted as an input terminal and the connector 10' connected to the terminal 16' adapted as an output terminal. While other four connectors 11, 11', 12 and 12' are connected in pair, meaning that the connectors 11 and 11' are connected in series so do the connectors 12 and 12'. Therefore, all the connectors are connected in series for connecting or disconnecting a DC current. In this example, the contactor is a three-pole contactor with three poles 4, 6, 8.

Figure 2A:
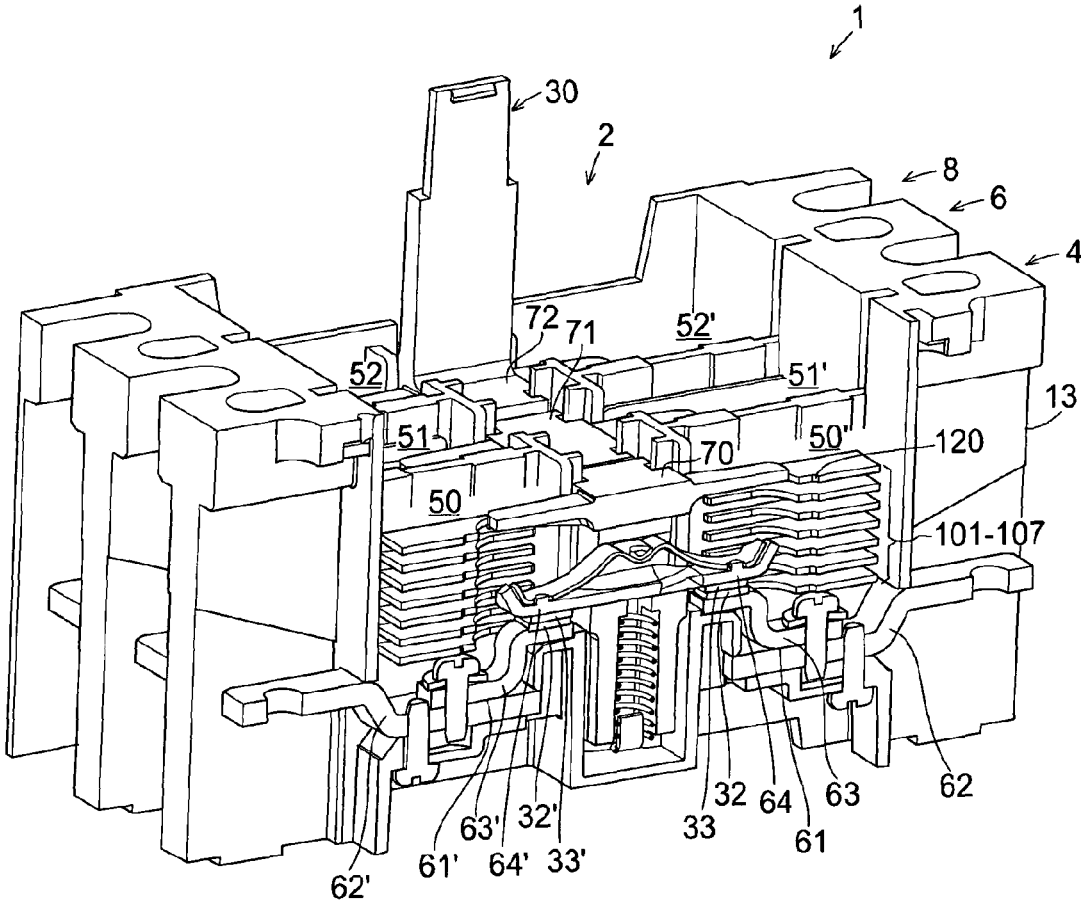
FIG. 2A illustrates a partial cross-sectional view of the unsealed contactor shown in FIG. 1, the contactor comprising a DC switching device of the present invention, according to an embodiment of the invention.
Figure 2B:
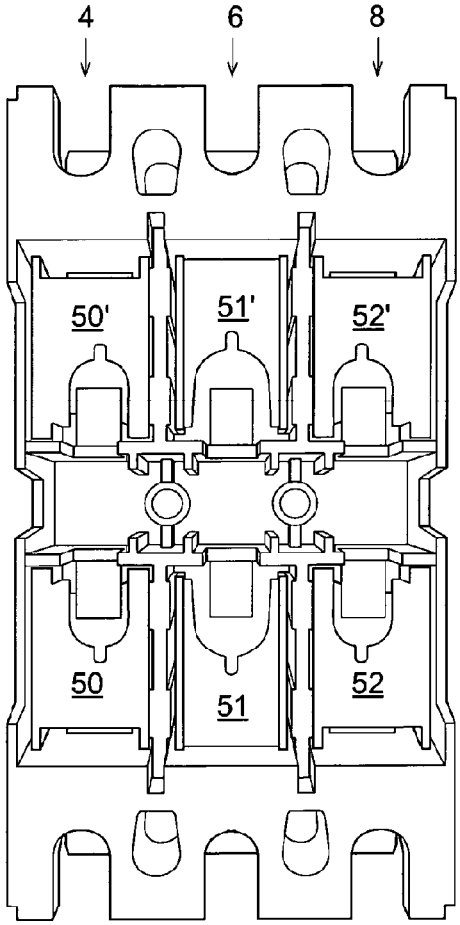
FIG. 2B is a horizontal cross sectional view of the DC switching device illustrated in FIG. 2*a;*
Figure 2C:
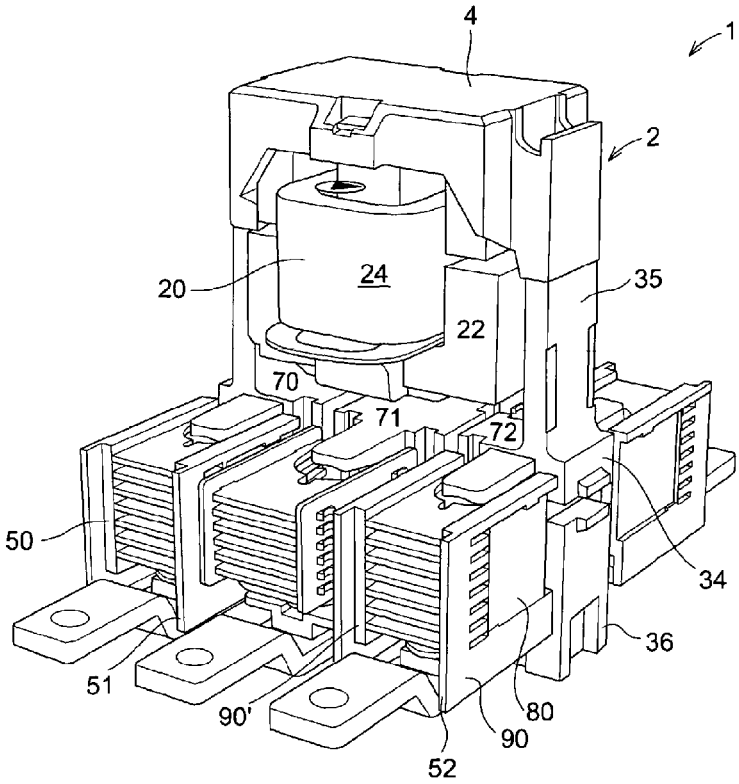
FIG. 2C shows a partial isometric view of the unsealed DC switching device shown in FIG. 1*a*.

With reference to FIG. 2*a-c*, a DC switching device 2 of the present invention is provided for the contactor shown in FIG. 1. The DC switching device 2 is enclosed by the housing 13 and the casing portion 17 when the contactor is sealed. The DC switching device 2 comprises a plurality of contacting units (70, 71, 72) connected in series and a number of arc-extinguishing chambers 50, 50', 51, 51', 52, 52'. In this example, three contacting units are provided to the DC switching device and six arc-extinguishing chambers 50, 50', 51, 51', 52, and 52' are provided on the housing 13 of the contactor and arranged respectively in pairs, 50 and 50', 51 and 51', 52 and 52' for enclosing a respective contacting unit 70, 71, 72. Each of arc-extinguishing chambers 50, 50', 51, 51', 52, 52' further comprises a splitter plate unit formed by a stack of splitter plates 101-107, which may for example be metal plates, i.e. ferromagnetic material or non-ferromagnetic plates. Each of the stacks may include 5-10 splitter plates. In this embodiment, seven splitter plates 101-107 are provided for each of the stacks of the splitter plates.

In this embodiment, four 50, 50', 52, 52' of the arc-extinguishing chambers arranged for outer poles 4, 8 are further provided with a permanent magnet (80) for generating a magnetic field between the contacting unit and the splitter plate unit when the contacts are separated and for those chambers, the splitter plates are made of non-ferromagnetic material, for example copper or the like; while other two arc-extinguishing chambers 51, 51' arranged for the inner/mid pole 6 are provided with ferromagnetic splitter plates, for example iron or the like. This arrangement enables maximal flux density from the permanent magnets arranged for the chambers of the outer poles so as to achieve a high breaking capacity.

Figure 3:
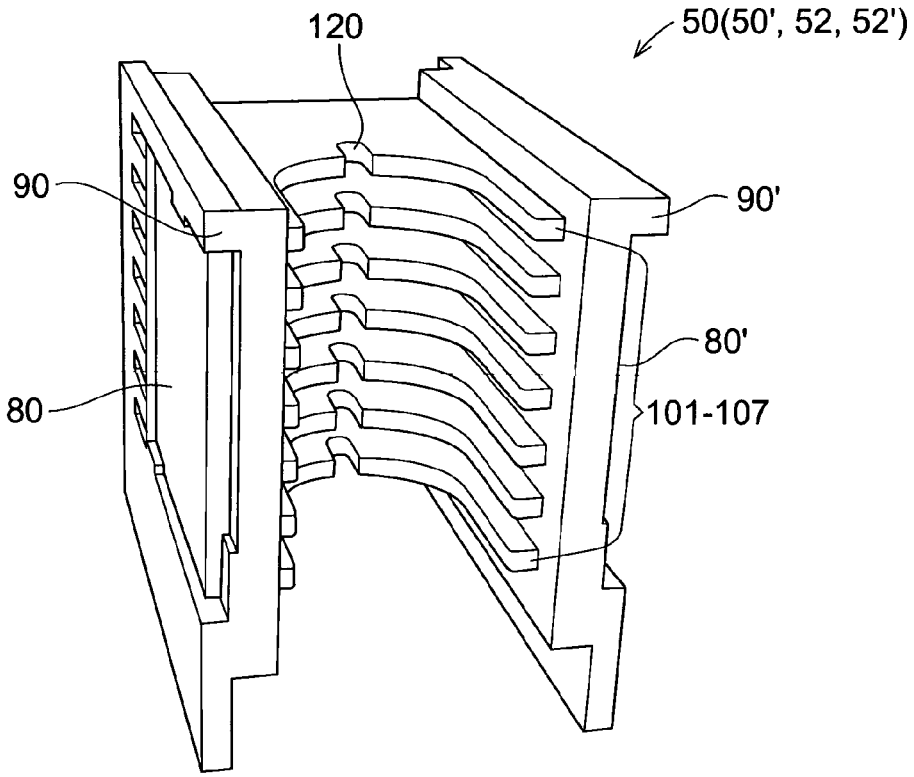
FIG. 3 illustrates a perspective view of the arc-extinguishing chamber provided with two permanent magnets arranged on sidewalls of the chamber.

With reference to the FIG. 3, two permanent magnets 80, 80' are further provided for each of the four arc-extinguishing chambers 50, 50', 52 and 52' and arranged adjacent to the splitter plates unit to provide a magnetic field across the chamber.

In this example, each 80, 80' of the permanent magnets is received by a permanent magnet holder 90, 90' and positioned on the external surfaces of the wall of the holder. The permanent magnet holder 90, 90' are perpendicular to the splitter plates with a groove to receive and position the permanent magnets. The arrangement of two permanent magnets 80, 80' provides a symmetrical and balanced magnetic force. Moreover, a single piece of magnet is preferred to avoid local effects that may trap the arc to the wall of the chamber. To achieve maximum effect, the magnets cover 70%-90% of the splitter plates unit. In this example, almost all the splitter plates are covered by the magnets. The permanent magnets 80, 80' may be a type of rare earth metals for example samarium cobalt in order to provide a strong magnetic field which will not vary with current magnitude.

With reference to FIG. 2*a* and FIG. 3, the splitter plates 101-107 are U-shaped with a central recess 120 and arranged in parallel with each other with the same distance between each other. The splitter plates may further comprise a leading edge 130 therethrough electric arcs enter into the chamber. The stack arrangement of the splitter plates is for splitting an arc into the number of elementary arcs, each of them therefore generating smaller arcing voltages due to the anode/cathode phenomenon and to its elongation. Thereafter, the arc is extinguished when the arc current value becomes and remains zero.

With reference to FIG. 2*a* and FIG. 2*c*, the DC switching device further comprises an actuating unit 4. Each of the contacting units 70, 71, 72 comprises a stationary part 60 including a stationary contact 61, 61' and a movable part including a contact carrier 34 and a movable contact 32 connected to the contact carrier 34. The contact carrier 34 including an upper part 35 and a lower part 36 is connected to the actuating unit 4. The actuating unit 4 comprises a movable magnetic part 30 and a fixed magnetic part 20 including a magnetic core 22 and a coil 23 and is adapted to carry the movable contact moving in a direction towards or away from the stationary contact between a rest position and a working position. The movable magnetic part 30 has an E-shaped form and made of a ferromagnetic material such as iron. The magnetic core 22 also has an E-shaped and made of a ferromagnetic material such as iron. The coil 23 comprises a bobbin member 24 with a conductive wire coiled around the bobbin member 24. The conductive wire is supplied with a current so as to control the electrical contact between the contacts.

The stationary contact 61, 61' are sited on the housing 13 of the contactor 1 and arranged aligned with the movable contact 32. Each 61, 61' of stationary contacts includes two bended parts 62, 63, 62', 63' which are fastened together by a screw. The upper bended part 63, 62 includes a contact pad 64, 64'. The movable contact 32 includes two movable contact pads 33, 33' sited respectively on each end of the movable contact 32 on the same side of the movable contact. The movable contacts are connected to the actuating unit 4 that drives the movable contacts from a working position to a rest position when a disconnection between the stationary and movable contacts is established or from a rest position to a working position when a connection between the stationary and movable contacts is established.

In the case of disconnecting/breaking of a high electric current, the magnetic induction generated by the current flow between the contacts is sufficient to remove the arc to the arc-extinguishing chamber.

However, when the DC switching device is used for disconnecting/breaking a relevant low current, the magnetic induction generated by the current flow between the contacts is no longer sufficient to remove the arc to the arc-extinguishing chamber due to the short distance of the air gap between the stationary and movable contacts, which results in insufficient voltage drop. With the magnetic field generated by the permanent magnets, the arc is driven all the way into the splitter plates during a shorter time and therein is split.

What is claimed is:

1. A DC switching device comprising a plurality of arc-extinguishing chambers and a plurality of contacting units conductively connected in series to each other, each of the contacting units including a stationary contact and a movable contact movable between a rest position and a working position, an air gap is formed between the contacts when the movable contact is moved from the working position to the rest position and each of the chambers enclosing a contacting unit and comprising a splitter plate unit including one or more splitter plates arranged for splitting and cooling an arc occurring in the air gap between the contacts, characterized in that at least one of the chambers includes a permanent magnet for generating a magnetic field between the contacting unit and the splitter plate unit and the splitter plates are made of non-ferromagnetic material, and the splitter plates of at least one of the chambers are made of ferromagnetic material.

2. The DC switching device according to claim 1, wherein the DC switching device comprises three chambers arranged next to each other in a row, the contacting unit of the mid chamber having a current direction opposite to the current directions of other contacting units of the other two chambers, the splitter plates of the mid chamber made of ferromagnetic material and each of the other two chambers including a permanent magnet and the splitter plates made of non-ferromagnetic material.

3. The DC switching device according to claim 1, wherein the permanent magnet is arranged adjacent to the splitter plate unit of the chamber.

4. The DC switching device according to claim 1, wherein the permanent magnet is extending from the stationary contact and further along one side of the splitter plate unit.

5. The DC switching device according to claim 1, wherein the permanent magnet is arranged to cover between 70%-90% of the side of the splitter plate unit.

6. The DC switching device according to claim 1, wherein a second permanent magnet is arranged on the opposite side of the splitter plate unit.

* * * * *